United States Patent [19]

Murahashi et al.

[11] 4,217,946

[45] Aug. 19, 1980

[54] METHOD OF MAKING MOLDS

[75] Inventors: Taro Murahashi; Yukuo Ogino, both of Osaka, Japan

[73] Assignee: Kokoku Steel Casting Company, Limited, Osaka, Japan

[21] Appl. No.: 43,012

[22] Filed: May 29, 1979

[51] Int. Cl.[3] ..... B22D 9/12

[52] U.S. Cl. ..... 164/12; 164/33; 164/41

[58] Field of Search ..... 164/12, 33, 138, 23, 164/24, 137, 14, 16; 249/112, 114 R, 115; 264/219, 225, 226; 29/460, 416

[56] References Cited

U.S. PATENT DOCUMENTS

| | | | |
|---|---|---|---|
| 2,903,761 | 9/1959 | Sirmay | 249/114 |
| 3,391,726 | 7/1968 | Edstrom | 249/114 |
| 3,438,424 | 4/1969 | North | 164/138 |

*Primary Examiner*—Robert D. Baldwin
*Assistant Examiner*—K. Y. Lin
*Attorney, Agent, or Firm*—Armstrong, Nikaido, Marmelstein & Kubovcik

[57] ABSTRACT

A method of making molds, wherein facing sand prepared by using a binder which will retain its plasticity for a long time is spread into a thin sheet, which is then cut into suitable pieces according to the shape of a pattern, which pieces are then placed on the surface of the pattern or applied thereto while being connected together, thereby forming a layer of facing sand of uniform thickness, whereupon backing sand is charged to fill the cavity and rammed around, thereby making a mold. This method is effective to reduce the amount of facing sand used, improve the dissipation of gases and heat and uniform the pressure-resisting strength in the various portions, thereby eliminating various casting defects.

6 Claims, 7 Drawing Figures

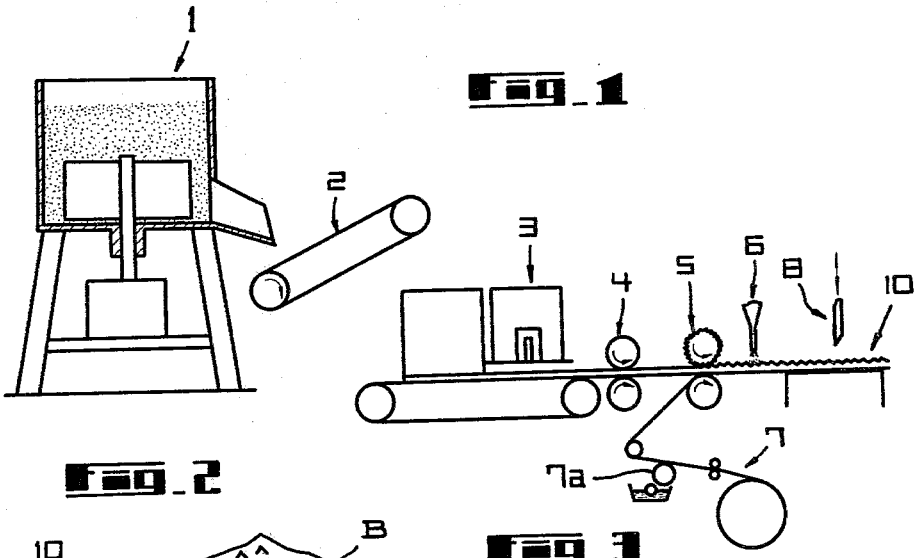
Fig. 1
Fig. 2
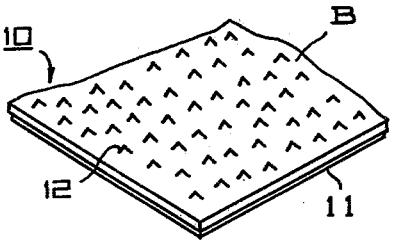
Fig. 3
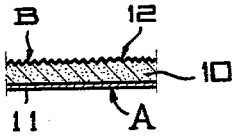
Fig. 4
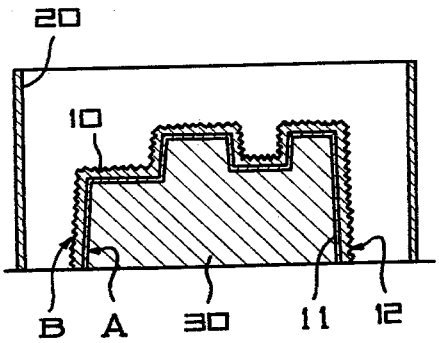
Fig. 5
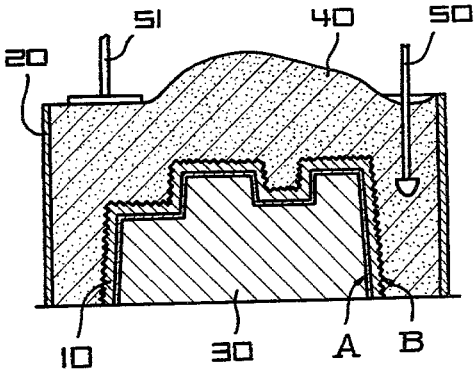

METHOD OF MAKING MOLDS

BACKGROUND OF THE INVENTION

1. Field of the Invention

The present invention relates to a method of making molds which comprises forming a thin sheet of facing sand having long-lasting plasticity, applying said sheet to the surface of a pattern, and charging backing sand to fill the cavity.

2. Description of the Prior Art

Generally, for facing sand, use is made of sand of fine particle size so as to attain a dense and smooth casting surface, said sand being mixed with an inorganic binder, such as sodium silicate and bentonite, or an organic resin binder, and an indefinte amount of such facing sand is manually applied to the surface of a pattern while being pressed thereagainst and backing sand is then charged to fill the cavity while being manually or mechnically rammed around, whereupon the pattern is removed to leave a mold.

Thus, according to the conventional method as described above, the amount of facing sand used is indefinite and the thickness of the layer of facing sand in the various portions is ununiform to the extent that the backing sand is sometimes exposed to the surface of the mold.

Therefore, the conventional method requires that the thickness of the layer of facing sand be at least 20 mm and usually 30 to 50 mm and in some cases exceed 100 mm.

The use of such a large amount of facing sand is disadvantageous in that it correspondingly increases the cost of making molds.

Since the facing sand is small in particle size, the increased thickness of the layer of facing sand will impede the dissipation of gases produced during the pouring of molten metal, resulting in a cause of casting defects.

Further, the increased thickness of the layer of facing sand will greately aggravate the dissipation of heat after casting, thus increasing the amount of sand burning, which, in turn, requires much time and labor for sand stripping subsequent to the opening of the mold.

On the other hand, the nonuniform thickness of the layer of facing sand results in the nonuniformity of the pressure-resisting strength to withstand the metal pouring pressure and also results in the nonuniformity of heat expansion, causing defects in the casting surface.

Further, the bentonite used in the conventional facing sand is a kind of clay which has a disadvantage that when dried, it loses its binding force, so that the layer of facing sand tends to collapse.

Further, sodium silicate and resin binders, such as furan, have self-curing property and will cure in a short time, thus having a disadvantage that it is impossible to retain plasticity for a long time.

SUMMARY OF THE INVENTION

The present invention is characterized in that facing sand is prepared by using a binder which will retain its plasticity for a long time, thereby making it possible to retain the facing sand for a long time, and in that the thus prepared facing sand is spread into a thin sheet which is then cut into suitable pieces accroding to the shape of a pattern and said pieces are applied to the surface of the pattern to form a layer of facing sand of uniform thickness, thereby reducing the amount of facing sand used, improving the dissipation of gases and heat and uniforming the pressure-resisting strength in the various portions, thereby eliminating various casting defects.

Further, the invention is characterized by the formation of irregularities on or the application of an adhesive agent to the back surface of said sheet of facing sand in order to improve the adhesion between the facing sand and the backing sand.

Further, the invention is characterized in that in order to facilitate the application of said sheet of facing sand to the lateral surface of a pattern, a thin sheet of hygroscopic paper is applied to the front surface of said layer of facing sand or instead pins or magnets when the pattern 30 is a magnetic material are used to temporarily fix the layer of facing sand to the surface of the pattern and while backing sand is being charged said pins or magnets are removed to complete the molding, and in that a layer of facing sand having no paper applied thereto is used to cover the top surface of the pattern.

It is preferable that said paper be peeled off when the pattern is withdrawn after the molding.

Further, as soon as the pattern is withdrawn after the molding, an aqueous solution of sodium silicate diluted with water is sprayed over or applied to the front surface of the mold and warmed by a burner or alcohol zinc is sparyed or applied thereto and ignited for baking. As a result, the organic matter in the facing sand is burnt out and the sodium silicate permeates the layer of facing sand while the zircon particles in the paint serve to make the surface of said layer denser and smoother.

Other features of the invention will be described in detail with reference to preferred embodiments of the invention.

BRIEF DESCRIPTION OF THE DRAWINGS

FIG. 1 is a complete side view showing an example of a machine for forming a sheet of facing sand used in the present invention;

FIG. 2 is a perspective view taken in a direction toward the back of a sheet of facing sand formed by the forming machine shown in FIG. 1;

FIG. 3 is an enlarged sectional view of said sheet of facing sand;

FIG. 4 is a sectional view showing a pattern covered with a sheet of facing sand;

FIG. 5 is sectional view showing the charging of backing sand in molding operation;

DESCRIPTION OF THE PREFERRED EMBODIMENT

Figure 6:
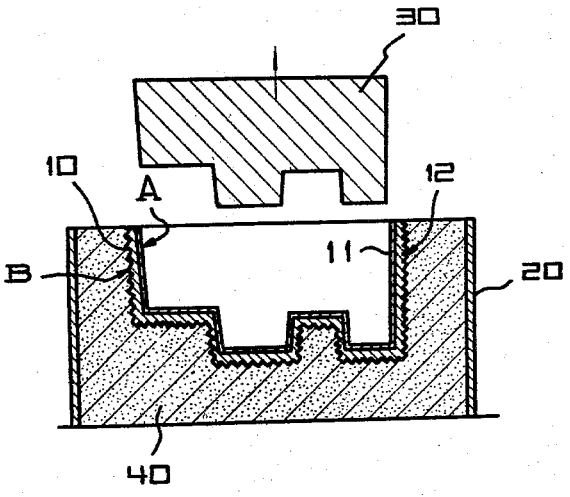
FIG. 6 is a sectional view showing the pattern being withdrawn.

FIG. 1 shows an example of a machine for forming a sheet of facing sand used in the present invention, wherein 1 designates a stirrer; 2 designates a conveyor; 3 designates a forming machine; 4 designates delivery rollers; 5 designates forming rollers; 6 designates an adhesive agent applicator; 7 designates a paper feeder; and 8 designates a cutter.

The stirrer 1 is fed with a material of suitable particle size serving as an aggregate for facing sand, such as silica sand, olivine sand, zircon sand, chromite sand, coated sand, or any other sand or powder of refractory material, i.e., a material heretofore used as facing sand, and a binder, in a suitable ratio, for stirring and mixing.

Such binders are those which will retain their plasticity for a long time, including rubber type binders having plasticity, such as latex, and other binders having the same properties as said rubber type binders.

The mixing ration is, for example, as follows.

| | |
|---|---|
| Silica sand | 100 parts by weight |
| Binder (latex) | 6 to 8 parts by weight |
| Zircon sand | 100 parts by weight |
| Binder (latex) | 3 to 5 parts by weight |
| Olivine sand | 100 parts by weight |
| Binder (latex) | 6 to 8 parts by weight |

The raw material for facing sand and the binder which are supplied with the mixing ratio described above are stirred and mixed by the stirrer 1, fed by the conveyor 2 to the forming machine 3, where the mixture is formed into a plate which is then formed into a thin sheet (1 to 5 mm thick) by the delivery rollers 4, said sheet being then processed by the forming rollers 5 to have irregularities formed on one surface thereof and paper from the paper feeder 7 applied to the other surface.

The paper mentioned above is hygroscopic and is fed after having paste applied thereto by a paste applicating roller 7*a*.

Further, the applicator 6 applies an adhesive agent, such as starch paste, to the surface on which irregularities are formed.

The sheet is then cut into suitable pieces by the cutter 8.

The sheet of facing sand 10 thus formed, as shown in FIGS. 2 and 3, has paper 11 applied to its front surface A and irregularities 12 formed on its back surface B, said irregular surface having an adhesive agent, such as starch paste, applied thereto.

The paper 11 serves to make it easier for the sheet of facing sand 10 to adhere to the surface of the pattern during molding.

Further, the irregularities 12 and the adhesive agent on the back surface B serve to improve the adhesion between the the backing sand and the facing sand during molding.

The sheet of facing sand 10 described above will retain its plasticity for a long time, such plasticity being utilized to make molds.

The mold making is carried out in the following manner.

As shown in FIG. 4, said sheet of facing sand 10 is cut into pieces according to the shape of a pattern 30 placed in a flask 20, said pieces being applied to the suface of the pattern 30. In this case, water has been sprayed over the surface of the pattern 30, and the sheet of facing sand 10 is applied to said surface of the pattern with the front surface A of the sheet in contact therewith. In this case, said surface A has the highly hygroscopic paper 11 applied thereto, so that the sheet of facing sand will intimately contact the surface of the pattern 30 by the action of the surface tension of water.

The high plasticity of the sheet of facing sand 10 allows the sheet to adapt itself to the irregularities on the surface of the pattern 30, and manual pressing or beating with a wooden hammer will enable the pieces of the sheet of facing sand 10 to be joined together.

Thus, even if the surface shape of the pattern 30 is complicated, on the assumption that said shape is composed of simple planes or curves, the sheet of facing sand 10 may be cut into pieces to conform to said simple planes or curves and said pieces may then be applied to the surface of the pattern and joined together, whereby a layer of facing sand which is contiunuous and uniform in thickness can be formed on the surface of the pattern 30.

After a layer of facing sand which is continuous and uniform in thickness has been formed on the surface of the pattern 30, water or a resin binder is sprayed over or applied to the back surface B of the layer of facing sand.

Thus, if ordinary sand is used as the backing sand, spraying water over the adhesive agent applied to the back surface B of the layer of facing sand will produce a sticking force which improves its adhesion to the backing sand.

If a backing sand of resin material is used, spraying of water will produce no sticking force because of said backing sand having water repellence, In this case, therefore, the sheet of facing sand should be coated with an adhesive agent of resin material which is effective for its adhesion to the backing sand.

With such arrangement thus made, backing sand 40 is then charged as shown in FIG. 5 and is rammed around by a rammer 50 and a stamp 51 or machanically rammed around for mold making.

The presence of the irregularities 12 and adhesive agent on the back surface B of the facing sand 10 improves its adhesion to the backing sand 40 for better union. Upon completion of ramming around of the backing sand, the pattern 30 is withdrawn (see FIG. 6).

The paper 11 on the surface of the facing sand 10 is peeled off and an aqueous solution of sodium silicate diluted with water is sprayed or applied. Alcohol zircon paint is then sprayed or applied and ignited for baking.

As a result, the sodium silicate permeates the facing sand 10 and the fine particles of zircon settle on the surface of the facing sand to further smooth the surface of the facing sand 10. Ignition in this condition burns the alcohol and hardens the sodium silicate to render the facing sand 10 ceramic-like, increasing its pressure and heat resisting strengths, while burning the organic ingredients contained in the facing sand so as to decrease the amount of gases to be produced during pouring of molten metal.

In addition, said alcohol zircon paint is prepared by mixing fine particles of zircon with industrial alcohol with stirring to produce a suspension.

The mold making operation is now completed, and molten metal may be poured in without needing to dry the mold.

While the above embodiment has been described with referenct to the making of a parent mold, the invention may also be applied to the making of a core.

Figure 7:
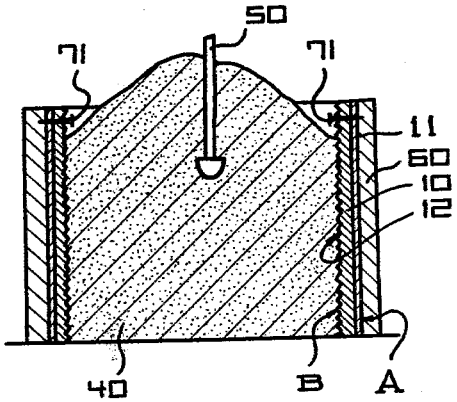
FIG. 7 is a diagrammatic view showing a molding operation with the invention applied to the making of core.

FIG. 7 illustrates an example of making a core, wherein a sheet of facing sand 10 is applied to the inner surface of a core flask 60. In this case, the fornt surface A of the sheet of facing sand 10 is contacted with the inner surface of the core flask 60 and the adhesion is preceded by wetting of the core flask 60 with water. Fastening pins 71 or magnets are used to fasten the upper portion of the sheet of facing sand 10 to the upper portion of the core flask 60 to prevent it from slipping down, and then backing sand 40 is charged and rammed around. In this case also, the same procedure as in the embodiment shown in FIGS. 4 through 6 is taken to improve the adhesion between the facing sand 10 and the backing sand 40, and the after-finish of the surface is also performed.

In addition, the fastening pins 71 or magnets will be removed when the backing sand 40 is rammed around up to the upper region, because at this time the sheet of facing sand 10 will no longer slip down. Backing sand 40 is then additionally charged up to the top and the core flask 60 is withdrawn and the core is finished similarly to the preceding embodiment.

While the method of making molds according to the invention is as described above, the paper 11 on the front surface A of the sheet of facing sand 10 may be omitted and either or both of said irregularities 12 and adhesive agent on the back surface B may also be omitted. Further, the application of an aqueous solution of sodium silicate and alcohol zircon paint subsequent to the withdrawal of the pattern may also be omitted or only such aqueous solution of sodium silicate may be applied and burnt by a burner.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. A method of making molds comprising the steps of preparing a facing sand material with a binder which will retain its plasticity for a long time, forming the material into a thin sheet of facing sand, cutting said sheet into pieces according to the shape of a pattern, applying said pieces to the surface of said pattern while joining them together along the junctions by the action of their plasticity to form a layer of facing sand which is continuous and uniform in thickness, charging backing sand for molding, and withdrawing the pattern.

2. A method of making molds comprising the steps of preparing a facing sand material with a binder which will retain its plasticity for a long time, forming the material into a thin sheet of facing sand, cutting said sheet into pieces according to the shape of a pattern, applying said pieces to the surface of said pattern while joining them together along the junctions by the action of their plasticity to form a layer of facing sand which is continuous and uniform in thickness, charging backing sand for molding, withdrawing the pattern, and applying an aqueous solution of sodium silicate or an organic curing agent to the surface of the layer of facing sand.

3. A method of making molds comprising the steps of preparing a facing sand material with a binder which will retain its plasticity for a long time, forming the material into a thin sheet of facing sand, cutting said sheet into pieces according to the shape of a pattern, applying said pieces to the surface of said pattern while joining them together along the junctions by the action of their plasticity to form a layer of facing sand which is continuous and uniform in thickness, charging backing sand for molding, withdrawing the pattern, applying an aqueous solution of sodium silicate to the surface of the layer of facing sand, allowing said solution to cure, applying an alcohol zircon paint thereto, and igniting it for baking.

4. A method of making molds as set forth in any one of claims 1 through 3, characterized in that paper which is highly hygroscopic is applied to the front surface of the sheet of said highly hygroscopic paper and allowed to absorb water during molding, whereby the sheet of facing sand is closely contacted with the surface of the pattern, and upon withdrawal of the pattern, said paper is peeled off.

5. A method of making molds as set forth in any one of claims 1 through 3, characterized in that the back surface of the sheet of facing sand is formed with irregularities and a layer of adhesive agent so as to improve the adhesion between the backing sand and the sheet of facing sand during molding operation.

6. A method of making molds as set forth in any one of claims 1 through 3, characterized in that when the sheet of facing sand is applied to the surface of the pattern, the upper portion of the sheet of facing sand is temporarily fastened to the surface of the pattern by a holding means selected from the groups consisting of pins and magnets to prevent said sheet from slipping down, and after backing sand is charged up to the temporarily fastened region and rammed around, said holding means are removed and backing sand is additionally charged to complete the molding.

* * * * *